United States Patent [19]

Conte

[11] 4,079,758

[45] Mar. 21, 1978

[54] DEVICE FOR INSERTING THE WEFT IN A GRIPPER SHUTTLE LOOM

[75] Inventor: Georges Conte, Villeurbanne, France

[73] Assignee: Mintiss, Lyon, France

[21] Appl. No.: 683,675

[22] Filed: May 5, 1976

[30] Foreign Application Priority Data

May 5, 1975 France ..... 75 14757

[51] Int. Cl.[2] ..... D03D 47/24

[52] U.S. Cl. ..... 139/438

[58] Field of Search ..... 139/437, 438, 439

[56] References Cited

U.S. PATENT DOCUMENTS

| | | | |
|---|---|---|---|
| 429,618 | 6/1890 | Greenleaf | 139/438 |
| 1,862,178 | 6/1932 | Dickie et al. | 139/437 |
| 3,861,428 | 1/1975 | Conte et al. | 139/439 |

FOREIGN PATENT DOCUMENTS

| | | |
|---|---|---|
| 1,558,972 | 1/1969 | France. |

*Primary Examiner*—Henry S. Jaudon

*Attorney, Agent, or Firm*—Fleit & Jacobson

[57] ABSTRACT

A gripper shuttle loom is provided with apparatus for passing weft yarn through the warp, comprising a pair of opposed lances on opposite sides of the loom arranged to be moved in unison half way into the shed where gripper shuttles carried by the lances are exchanged. Each shuttle has a pair of jaws for clamping the yarn which is supplied from a single reserve located on one side of the loom where means is provided for cutting the yarn, and inserting the yarn between the jaws. On the other side of the loom means is arranged to open the jaws to release the yarn. Each lance includes a member operable when the lance is at the center of the shed, by a cam drive linked with the loom shaft, for releasing one gripper shuttle and locking the other to the lance.

9 Claims, 9 Drawing Figures

DEVICE FOR INSERTING THE WEFT IN A GRIPPER SHUTTLE LOOM

This invention relates to a device for inserting the weft in a gripper shuttle loom.

In gripper shuttle looms a gripper shuttle which does not carry the yarn reserve moves through the shed to bring into position successive weft yarns. Numerous systems have been suggested in the past for moving the gripper shuttle in such looms, and, as a rule, use is made of a single member which places a weft yarn into position during each of its forward and return movements, taking the yarn alternately from two reserves disposed on opposite sides of the loom.

In order to eliminate the second yarn reserve and the mechanism for feeding that yarn to the shuttle, a number of gripper shuttles can be used which operate in only one direction, means being provided to recycle the shuttles successively.

These machines are expensive and difficult to manufacture, and they have not been widely adopted in the textile industry.

In accordance with the present invention there is provided a method of passing weft yarn supplied from a single yarn reserve through the warp of a shuttleless loom, wherein a gripper shuttle which grips the weft yarn is passed through the shed, and at the same time a second gripper shuttle is passed through the shed in the opposite direction to the first shuttle for taking over the weft yarn supplied from the single yarn reserve to pass the next weft yarn through the shed.

The invention also provides an apparatus for performing the method, comprising two opposed lances having facing ends arranged to move substantially through half the width of the shed to the centre thereof, and means on the end of each lance operative when the lance is at the centre of the shed to lock to the lance a gripper shuttle which it receives from the other lance, and at the same time to release a gripper shuttle carried thereby to allow gripper shuttle to be transferred to the other lance.

A better understanding of the invention will be had from the following description, given by way of example, with reference to the accompanying drawings, in which.

Figure 1:
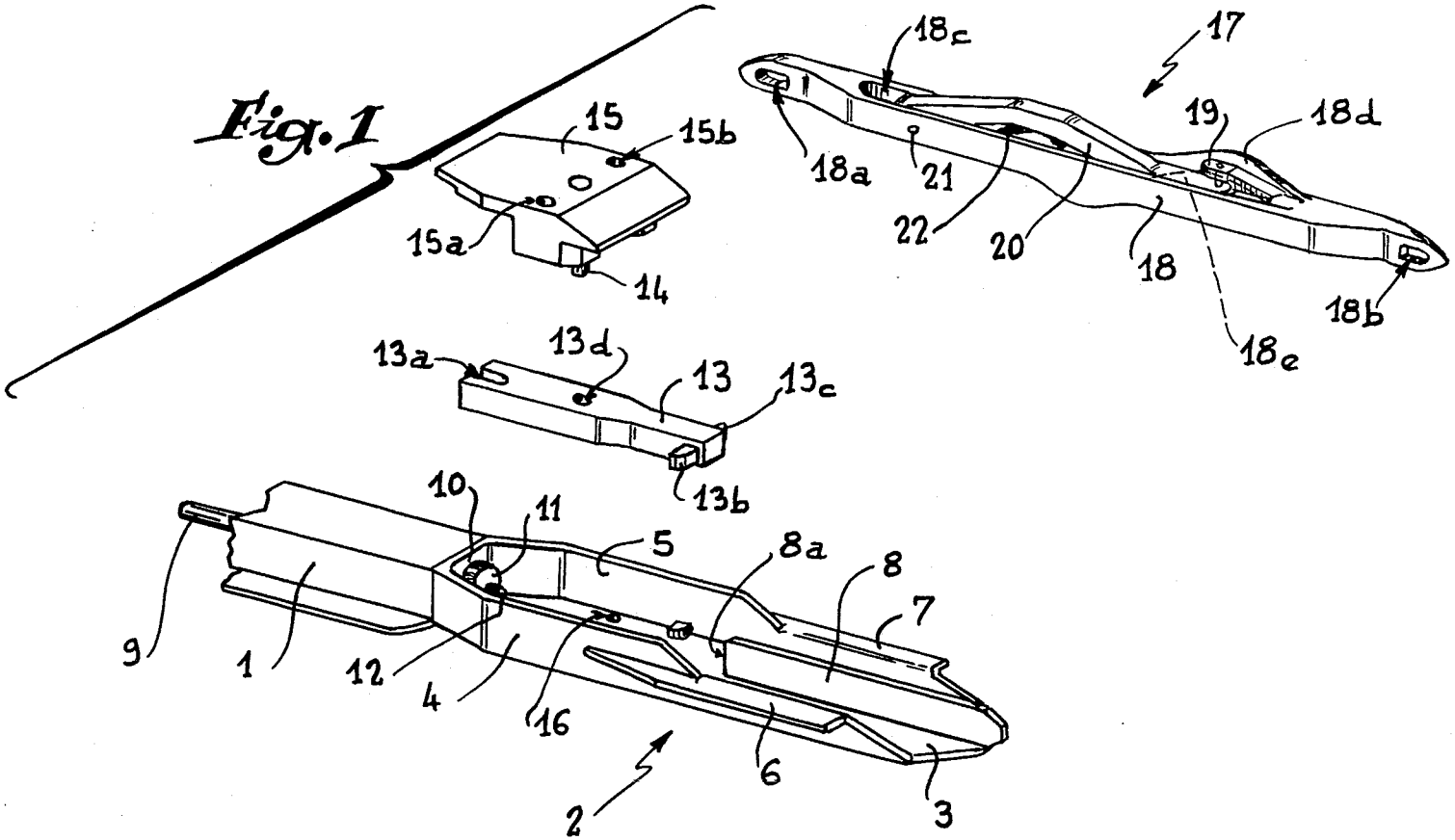
FIG. 1 is a perspective view showing the end of a loom lance and a gripper shuttle suitable for the insertion of successive weft yarns into the shed.

FIG. 1 shows one of the two identical lances of a loom. The lance comprises a square tube 1 with a cup 2 at one of its ends having a horizontal bottom 3 and vertical side walls 4, 5. These walls 4, 5 extend from the point of connection of the tube 1 and the cup 2 for approximately one half their length with a first height, then for the remaining portion of their length the height is substantially reduced to only about one half of the original height. The walls 4, 5 have small horizontal flanges 6, 7 and a vertical, axial partition 8 is disposed on the bottom 3 so as to divide the cup 2 into two identical compartments.

A rod 9 extends longitudinally in the tube 1 of the lance and through the rear end 10 of the cup, the rod is journalled in the partition 10, and supports inside the cup a cam 11 having a crank pin 12. Disposed between the cam and the rear vertical edge **8*a* of the partition 8 is a pawl 13 which rests on the bottom 3, and has one of its ends formed with a slot 13*a* in which the crank pin 12 engages. The opposite end of the pawl bears two studs 13*b*, 13*c* whose function will be explained below. The pawl is formed with a hole 13*d* perpendicular to the end 3 of the cup 2, the hole 13*d* receiving a vertical stub shaft 14 extending from the lower face of a cover 15 which fits over the cup at the top of the side walls 4, 5. The cover is retained in position by means of screws (not shown) extending through holes 15*a*, 15*b* in the cover and screwed into tapped holes 16 in the bottom 3** of the cup.

Each of the compartments of the cup 2 is adapted to receive a gripper shuttle 17 formed by an elongate body 18 with horizontal oblong apertures **18*a*, 18*b* in its ends. A central portion of the body 18 comprises a fixed lug or jaw 19 extending above longitudinal groove 18*c* in the body. The base of the body rests on the bottom 3 of the cup. The groove 18*c* receives a lever 20, one end of which is pivoted on a horizontal pivot pin 21, while its other end is pressed against the jaw 19 by a spring 22. The yarn is gripped by the shuttle in a conventional manner between the free end of the lever 20 and the jaw 19. The upper face of the body 18 has two small flanges 18*d*, 18*e* the latter of which has been shown in phantom by dashed lines in order to make the drawing easier to understand, the small flanges 18*d*, 18*e* being disposed on either side of the jaw 19**, and being greater in height than the latter.

Figure 2:
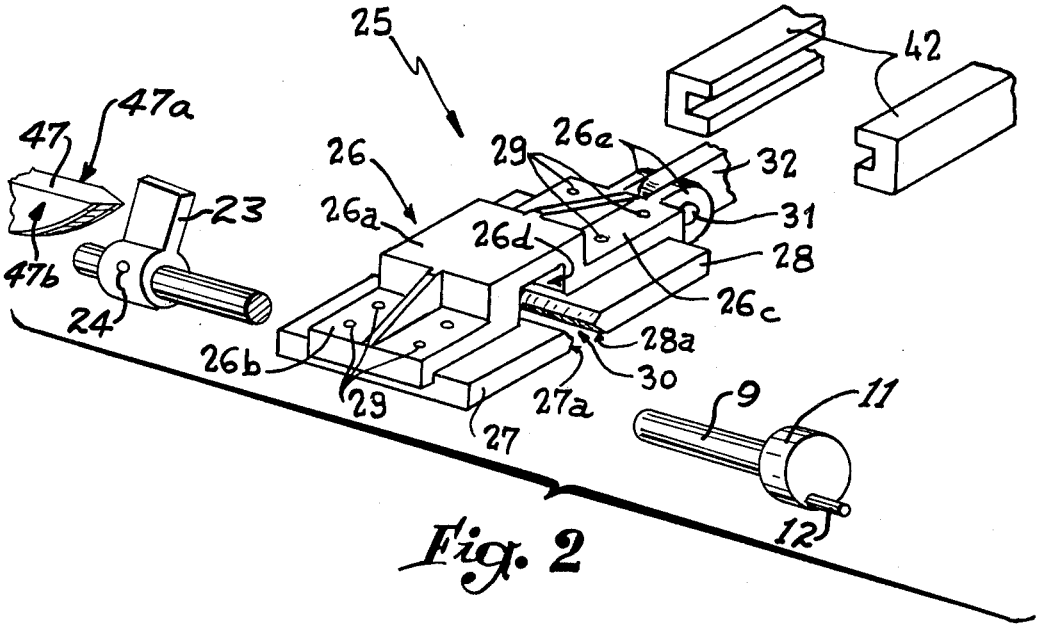
FIG. 2 is an exploded perspective view of the mechanism for controlling the member adapted to retain and release the gripper shuttle at the end of the lance.
Figure 3:
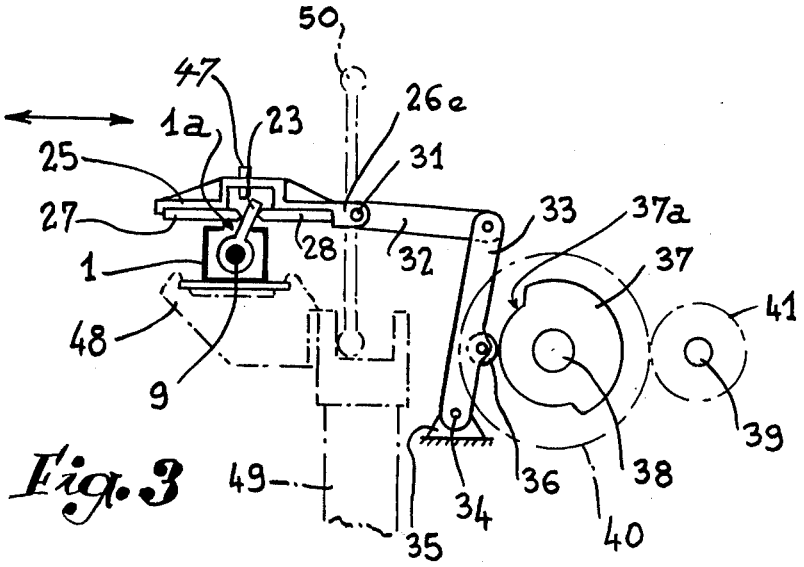
FIG. 3 illustrates the means adapted to actuate the control mechanism illustrated in FIG. 2.

The end of the rod 9 remote from the cam 11 carries a finger 23 angularly wedged to the rod 9 by a pin 24 (FIG. 2). This finger extends through an aperture **1*a* in the tube 1** of the lance (FIG. 3).

To manoeuvre the finger 23, a distributor device 25 is provided (FIG. 2). It comprises a support 26 taking the form of a central block **26*a* having two lateral flanges 26*b*, 26*c*. The lower face of the block 26*a* is hollowed out to form a passage 26*d* parallel with the rod 9. The inner faces of the flanges 26*b* and 26*c* are connected to soles 27 and 28, respectively, by screws 29, the two soles leaving between them a space 30 whose width is slightly larger than the thickness of the finger 23. The two opposite edges 27*a*, 28*a* of the soles 27, 28 are V-shaped for reasons which will be explained below. As shown in FIG. 3, the end portion of the flange 26*c* of the block 26 has lugs 26*e* forming a clevis comprising a pivot pin 31 to which one of the ends of a small link 32 is pivotably connected. The opposite end of the link is articulated to the end of a lever 33 whose opposite end is connected to a pivot 34 mounted in a clevis on the loom frame. The lever 33 carries rotatably a roller 36 which is resiliently applied against a generally circular cam 37 fast on a secondary shaft 38 which is rotated half as fast as primary shaft 39 of the loom by means of suitably dimensioned pinions 40,41. Over half 37*a* its periphery the cam is of smaller radius than that of the rest of the cam, so that as the cam rotates the distributor 26 reciprocates in a direction perpendicular to the length of the rod 9**.

The reciprocation of the distributor 25 is guided by horizontal slides 42 on the loom frame (FIG. 2). Clearly, since the rotation of the cam is twice as slow as that of the loom shaft 39 which is part of the main power transmission of the entire loom drive, each finger 23 is actuated only once per revolution of the shaft 39, i.e. the finger 23 remains in the same position during each travel of the lance backwards and forwards. The drive is so arranged that the finger is tilted when the cups of the lances are in the middle of the shed.

Figure 4:
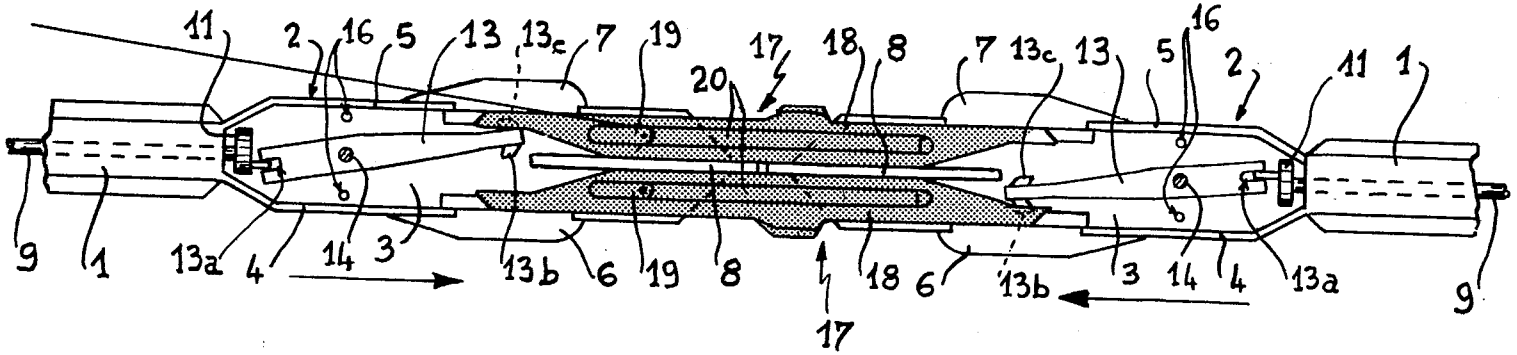
FIGS. 4 and 5 are plan views of the two lances at the moment when their movement is reversed at the centre of the shed and just after such reversal, respectively.
Figure 5:
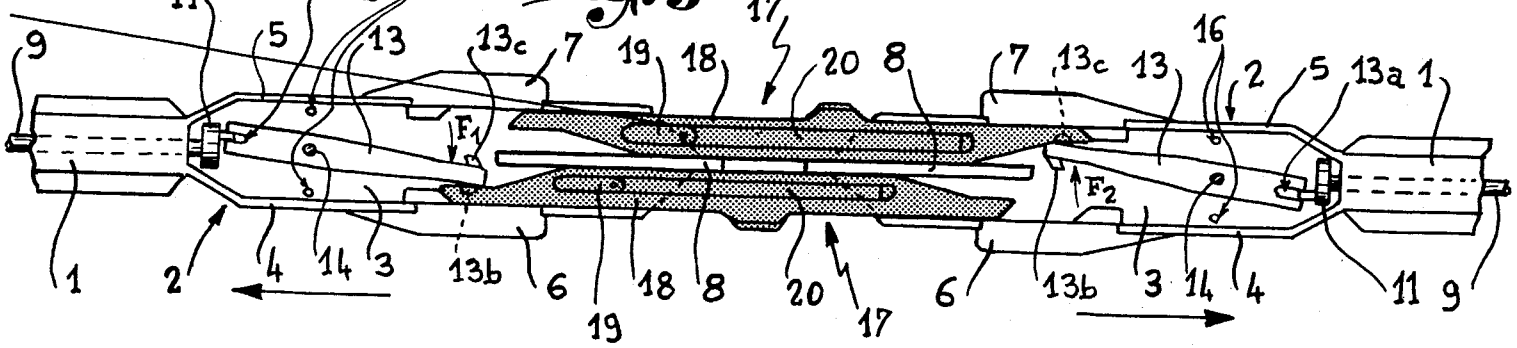

As will be explained in detail below, when the finger 23 is disposed in the space 30, movement of the distributor 25 causes rotation of the cam 11 and crank pin 12, to move the pawl 13 either to the position shown in FIG. 4 or that shown in FIG. 5 according to whether the roller 36 bears against the cam portion 37*a* or against the other, larger diameter portion of the cam 37.

Of course, as shown in FIGS. 6 – 9, on each side of the loom there is an assembly as described above, the assemblies operating in opposite directions. Also shown in FIGS. 6 through 9 is the location of the distributor 25 in relation to the frame F. Each distributor 25 is mounted on a plate affixed to the inboard side of the frame member F, and the end of the stroke of cup 2 of each lance is therefore situated just before its corresponding distributor 25. Accordingly, the distance between the distributor 25 and the middle of the shed is such that when the two lance cups are in that location, the finger 23 of each lance is situated in the space 30 between the sole plates 27 and 28 of the distributor 25.

Figures 6, 7, 8, 9:
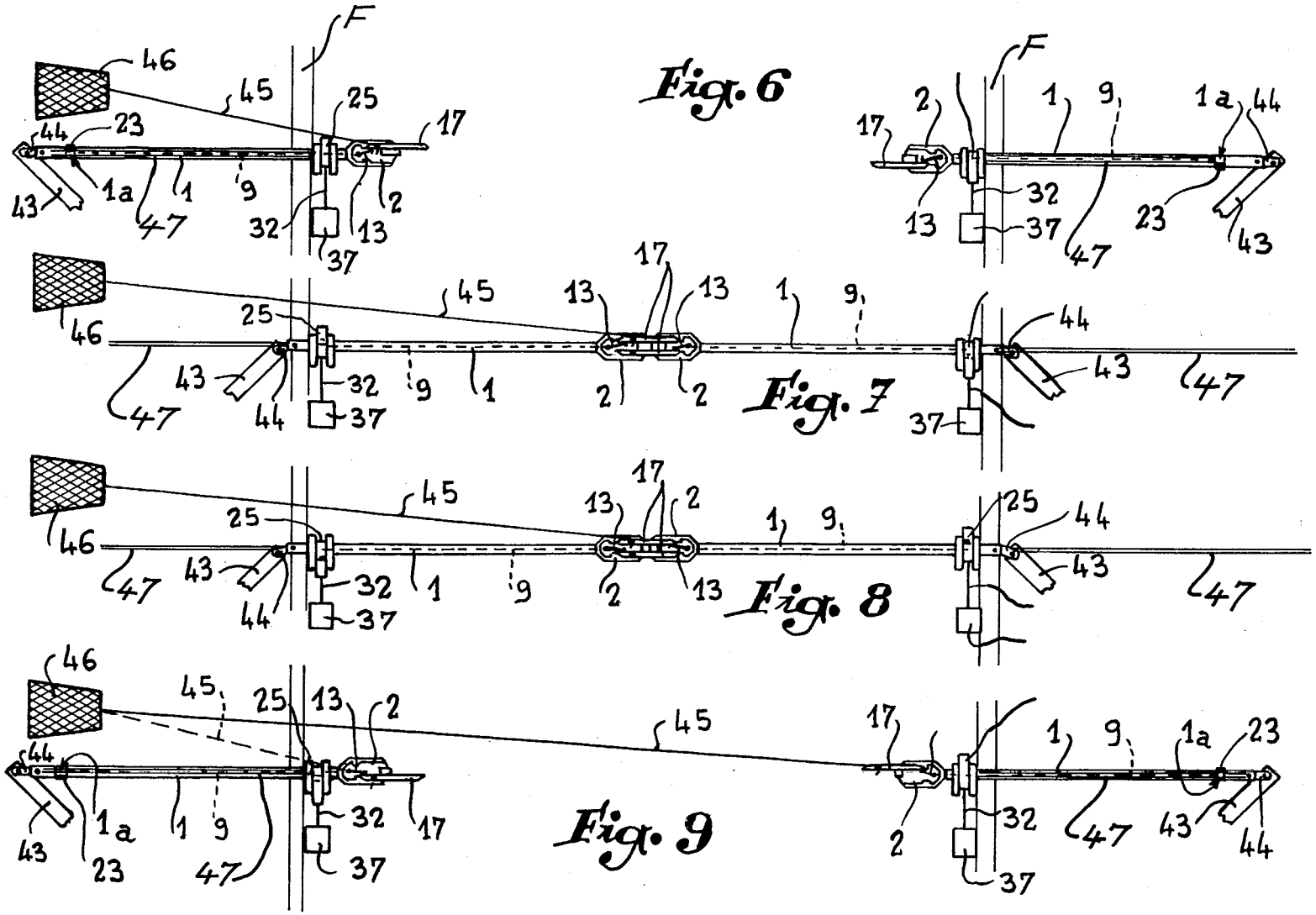
FIGS. 6 to 9 illustrate diagrammatically the operation of the control mechanism.

FIG. 6 shows the lances disposed completely outside the loom before they enter the shed. Each of the lances is actuated in known manner by a lever 43 connected to the lance by a link 44. Each of the distributors 25 is in a position which is fixed in relation to the working axis of the loom, and is such that when the lances are completely engaged in the shed (FIGS. 7 and 8) the fingers 23 are in the spaces 30 of the distributors 25. The cup 2 of the left-hand lance retains a gripper shuttle 17 in which the end of a yarn 45 supplied from a reserve 46 is clamped, while the cup 2 of the right-hand lance retains a false shuttle 17 independent of the yarn 45. When the levers 43 are actuated they cause a movement of the lances over a distance equal to half the width of the shed, so that their cups are placed exactly opposite one another (FIG. 7) with the gripper shuttle carried by each cup opposite the free compartment of the other cup. At the end of this movement the fingers 23 associated with the rods 9 move into the spaces 30 of the distributors 25, as explained above. At this moment the rollers 36 pass from one part of the cams 37 to the other (FIG. 3), so that each of the distributors 25 is moved in its slides 42 to produce tilting movement of the fingers 23, which causes rotation of the cams 11 and crank pins 12. The cam 37 acting on the roller 36 of the distributor on one side of the loom is shaped conversely to that of the distributor disposed on the other side of the loom, so that the distributors 25 move in unison, but in opposite directions. FIGS. 6 and 9 show that the fingers 23 occupy opposite positions. The tilting of the finger 23 is facilitated by the V-shaped edges of the flanges 27*a*, 28*a* of the soles 27, 28 which act on the fingers.

When the two cups 2 are in the centre of the shed (FIGS. 4 and 7), the gripper shuttle 17 clamping the yarn 45 is retained in one of them by the stud 13*c* of the pawl 13, while the other gripper shuttle is retained by the stud 14*b* of the corresponding pawl of the other lance. The retention of each of the gripper shuttles by the stud is performed by their engaging in one or other of the apertures 18*a* or 18*b* of the body 18 of the gripper shuttle.

When the two cups reach their reversal point, the roller 36 of each of the levers 37 passes from one cam portion to the other causing a change in position of the crank pin 12, since each distributor 25 actuates the associated finger 23. In this way the pawls 13 move from the position illustrated in FIG. 4 into that illustrated in FIG. 5, one of them pivoting in the direction indicated by the arrow $F_1$ and the other in the direction indicated by the arrow $F_2$, whereby each pawl releases one gripper shuttle and locks the other.

When the lances move away from one another to return to their starting positions, the gripper shuttle clamping the yarn 45 continues its travel in the shed to insert a weft yarn, the yarn being carried by the right-hand lance (as seen in the drawings) while the left-hand lance returns to its starting position with the other gripper shuttle.

During the reciprocating movement of each lance, the associated finger 23 is retained in one of its extreme positions by cooperation with one or other of the two lateral faces 47*a*, 47*b* of a guide 47 (FIG. 2) disposed parallel with the path of the lances. The ends of guide 47 are located adjacent the distributors 25 so that finger 23, when moving along its path of travel moves from engagement with guide 47 and into space 30. It is here that finger 23 is shifted to be aligned with the opposite side of guide 47. The retention of the finger 23 against angular displacement therefore does not require the use of any complicated member which may easily be disturbed.

The transfer of the gripper shuttles is shown diagrammatically in FIGS. 7 and 8 which also illustrate the converse operation of the distributors 25 disposed on either side of the loom. The small link 44 prevents any transverse forces being exerted by the levers 43 on the lances, which are guided on the top face of a number of transverse supports 48 (FIG. 3) unitary with the sley 49 bearing the reed 50. The supports 48 extend along the sley throughout the entire path traveled by the lances.

When the lances have returned to their starting positions, a device (not shown) cuts the yarn 45 and places it between the fixed jaw 19 and the lever 20 of the false shuttle closest to the yarn reserve 46. For this purpose a member pushes in the lever 20 and then releases it when the yarn has become engaged beneath the fixed jaw 19. In the same way the gripper shuttle which has just passed through the shed, clamping the weft yarn, cooperates with a ramp or other suitable fixed actuating means (not shown) which acts on its lever 20 by forcing it downward against spring 22 thereby releasing it from arm 19 and hence acting to release the yarn.

The presence of the small flanges 18*d*, 18*e* on the upper face of each false shuttle prevents the jaw 19 from catching any warp yarn closing on it.

I claim:

1. A method of weaving in which weft yarn supplied from a single yarn reserve is drawn into the warp of a gripper shuttle loom, comprising; gripping an end of said weft yarn with a gripper shuttle, moving said gripper shuttle into and through a warp shed in one direction, so as to draw said weft yarn into said shed, at the same time moving a second gripper shuttle into and through the shed in the direction opposite to said one direction and into position to receive the weft yarn from said reserve which is to be inserted into the subsequent warp shed.

2. A loom comprising; two gripper shuttles, two opposed lances having facing ends each carrying one of said gripper shuttles and arranged to move substantially into a shed formed in the warp to substantially the center thereof so that both gripper shuttles are moved into engagement with both facing ends, and means on each end of each lance operative when said lance is at said center of the shed to lock to said lance the one of said gripper shuttles received from the other said lance, and at the same time release the one of said gripper shuttles carried thereby so that each of said gripper shuttles is transferred to said other lance.

3. Apparatus according to claim 2, wherein each said gripper shuttle has clamping means for clamping weft yarn supplied from a single reserve.

4. Apparatus according to claim 3, wherein said clamping means comprises a fixed horizontal jaw and a movable jaw resiliently urged towards the fixed jaw, a member being arranged to cooperate with said movable jaw to open the jaws when said gripper shuttle reaches the end of its outward movement.

5. Apparatus according to claim 3 wherein each said gripper shuttle comprises at least one small flange for deflecting warp yarn away from said gripper as said gripper is drawn into the warp shed.

6. Apparatus according to claim 2, wherein the end of each lance comprises a cup having two compartments disposed side by side, a pivotal member arranged to cooperate with said gripper shuttles to lock one or other of the gripper shuttles to said lance, a longitudinal rod which controls pivotal movement of said member, and an operating finger on said rod for turning the rod to pivot said member, a guide being provided with which said finger cooperates during movement of said lance to prevent said rod turning.

7. Apparatus according to claim 6, wherein a reciprocating device is provided for actuating said finger and is arranged to be controlled from a loom power transmission shaft.

8. Apparatus according to claim 7, wherein said reciprocating device is controlled by a cam having two, concentric circular segments of different radii, and drive means is provided for rotating said cam at half the speed of the loom shaft.

9. Apparatus according to claim 2, wherein each said lance is connected to a control arm for moving the lance into and out of the shed through a short link.

* * * * *